US007013830B1

(12) United States Patent
Willis

(10) Patent No.: US 7,013,830 B1
(45) Date of Patent: Mar. 21, 2006

(54) TILTABLE BOAT TOP

(75) Inventor: D. Wayne Willis, Harkers Island, NC (US)

(73) Assignee: SmarTop, Inc., Morehead City, NC (US)

( * ) Notice: Subject to any disclaimer, the term of this patent is extended or adjusted under 35 U.S.C. 154(b) by 0 days.

(21) Appl. No.: 10/957,510

(22) Filed: Oct. 1, 2004

Related U.S. Application Data

(63) Continuation of application No. 10/327,843, filed on Dec. 23, 2002, now Pat. No. 6,799,529.

(51) Int. Cl.
*B63B 17/00* (2006.01)

(52) U.S. Cl. ..... 114/361

(58) Field of Classification Search ..... 114/361; 135/88.01, 88.02, 88.03
See application file for complete search history.

(56) References Cited

U.S. PATENT DOCUMENTS

| | | | | |
|---|---|---|---|---|
| 245,641 | A | 8/1881 | Meech | |
| 245,651 | A * | 8/1881 | Meech | 135/153 |
| 869,399 | A | 10/1907 | Walter | |
| 2,280,729 | A | 4/1942 | Sutton | |
| 3,035,281 | A | 5/1962 | Pearson | |
| 4,724,791 | A | 2/1988 | McSorley | |
| 5,016,558 | A | 5/1991 | Oehler | |
| 5,044,298 | A | 9/1991 | Pepper et al. | |
| 5,240,020 | A | 8/1993 | Byers | |
| 5,673,507 | A | 10/1997 | Stokes, Jr. | |
| 5,842,732 | A | 12/1998 | Daggett et al. | |
| 5,904,114 | A * | 5/1999 | Wright | 114/361 |
| 5,931,114 | A | 8/1999 | Bartholomew | |
| 6,059,351 | A | 5/2000 | Ehnes | |
| 6,192,819 | B1 | 2/2001 | Larson et al. | |
| 6,327,993 | B1 | 12/2001 | Richens, Jr. | |
| 6,349,666 | B1 | 2/2002 | Hastings | |
| 6,439,150 | B1 | 8/2002 | Murphy et al. | |
| 6,666,163 | B1 | 12/2003 | Pastor et al. | |
| 6,863,016 | B1 * | 3/2005 | Biemiller | 114/361 |
| 2003/0217683 | A1 * | 11/2003 | Heckman | 114/361 |

* cited by examiner

*Primary Examiner*—Andrew D. Wright

(57) ABSTRACT

A tiltable top is provided for a small boat which allows the boat operator to quickly, manually raise or lower the top as desired. The tiltable top includes a pivotal shade frame and cover which is retained in a normal horizontal position during use or which can be released and allowed to pivot to an acute horizontal angle to lower wind resistence of the boat when the top is lowered.

14 Claims, 6 Drawing Sheets

TILTABLE BOAT TOP

This is a continuation of and claims benefits under prior application Ser. No. 10/327,843 filed 23 Dec. 2002, now U.S. Pat. No. 6,799,529 issued 5 Oct. 2004.

FIELD OF THE INVENTION

The present invention pertains to a boat top for use on skiffs and other small boats. The top includes an arch which is affixed to the boat gunwales and has a pivotable shade frame. The top can be tilted from its upright position to a dormant position in a quick, efficient manner.

DESCRIPTION OF THE PRIOR ART AND OBJECTIVES OF THE INVENTION

Various types of tops have been used on small boats in the past as shown in U.S. Pat. Nos. 5,931,114, 6,327,993 and 6,349,666. While these tops generally serve the intended purpose they do not offer the protection and sturdiness desired in adverse weather conditions. In addition, certain conventional boat tops can not remain upright while being towed at highway speeds. Other standard tops do not provide side spray protection while underway. Other such tops are bulky, difficult to raise, lower or remove and occupy needed interior space beside the steering console.

Thus, with the problems and disadvantages of prior boat tops, the present invention was conceived and one of its objectives is to provide a tiltable boat top which can be raised to provide shade and weather protection in adverse conditions with a minimum of wind resistance and which can be quickly, easily lowered by one person as desired.

It is another objective of the present invention to provide a boat top which is pivotally affixed to the gunwales of a boat.

It is a further objective of the present invention to provide a boat top having an arch which can be tilted forward at an approximate 90° angle when not in use and the attached shade frame pivoted to an acute horizontal angle.

It is still another objective of the present invention to provide a boat top which can be quickly erected by an inexperienced person and can be manually lowered to a dormant position in a matter of minutes.

It is a further objective of the invention to provide a tiltable top which is fully supported along the top of the arch for wind and water stability and to allow storage, or attachment of needed appliances or items;

It is also an objective of the present invention to provide a durable and sturdy boat top for use on a variety of boats which can be manufactured inexpensively using conventional materials.

Various other objectives and advantages of the present invention will become apparent to those skilled in the art as a more detailed description is set forth below.

SUMMARY OF THE INVENTION

The aforesaid and other objectives are realized by providing a boat top which includes an arch formed of front and rear tubular frame members and which is releasably, pivotably affixed to the boat gunwales along each side. The arch is positioned above the steering console and attached windshield and a flexible cover is attached to a shade frame which pivotably joins the arch. The shade frame is releasably affixed to the front tubular frame member and is pivotably affixed to the rear tubular frame member. Each tubular frame member has an inverted U-shape with a pair of legs which are joined at the top by a transverse member. The front and rear tubular frame members are positioned over the steering console and are attached to the gunwales. The front frame member legs are pivotably joined to the gunwales and the rear frame member legs are releasably joined thereto.

Once erected, to rapidly lower the top, the rear frame member legs on each side of the boat are manually released from the gunwale by removing a locking pin. A pair of shade frame brace pins are also removed, allowing the top to pivot approximately 90° (forward) toward the bow of the boat. By removing a pair of wing nuts which retain bolts which attach the shade frame to the front frame member, the shade frame can then pivot about the rear frame member to allow the shade frame to rest in its dormant position at an acute angle to the horizon below the console windshield. This accommodates the boat's passing under low bridges as needed and easy storage in conventional vehicle garages. The shade frame with its cover to reduce wind resistance by its angle of incidence while in the dormant position when the boat travels at high rates of speed on the water or while being towed behind a vehicle along a highway.

On each side of the boat top, a splash panel having an arm rest is positioned between the tubular frame members. The splash panel helps protect the boat operator from water spray while underway. The side panels can also be used to suspend a fire extinguisher, a small tool cabinet or the like. A gasket placed on each of the gunwales between the tubular members acts as a sealing strip between the splash panel and the gunwale. A storage chest is also provided beneath the shade frame and is attached such as by welding or bolting to the transverse members. The storage chest may contain maps, equipment and the like in a convenient secure, dry manner.

DETAILED DESCRIPTION OF THE PREFERRED EMBODIMENT AND OPERATION OF THE INVENTION

Figure 1:
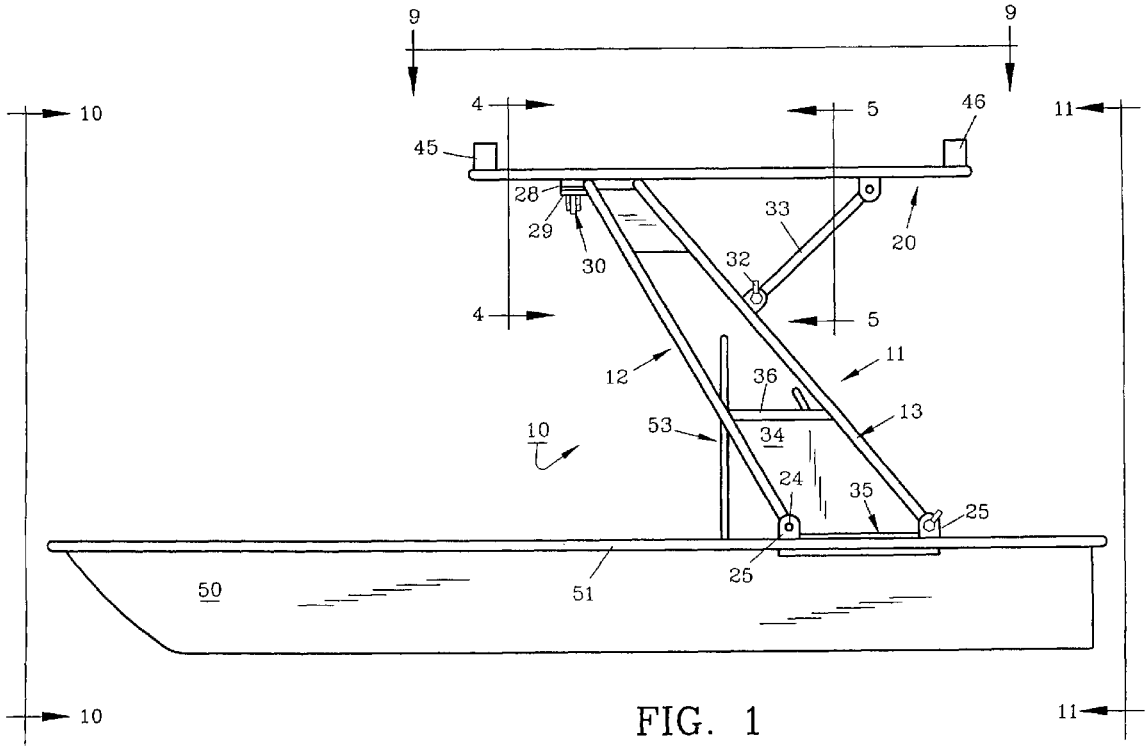
FIG. 1 illustrates a left side elevational view of the tiltable boat top of the invention mounted on a skiff.
Figure 2:
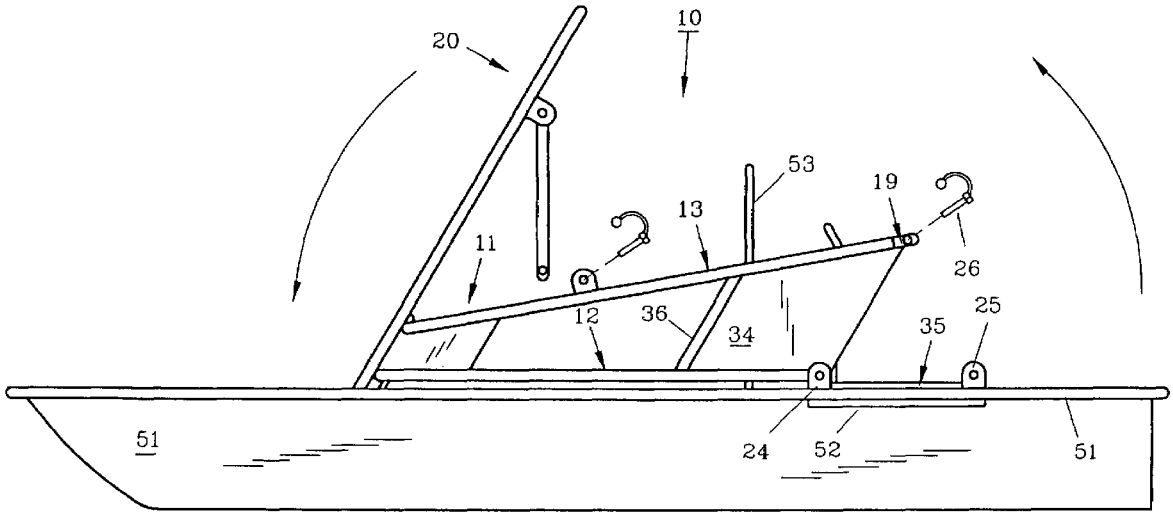
FIG. 2 shows the top as seen in FIG. 1 initially tilted forwardly.
Figure 3:
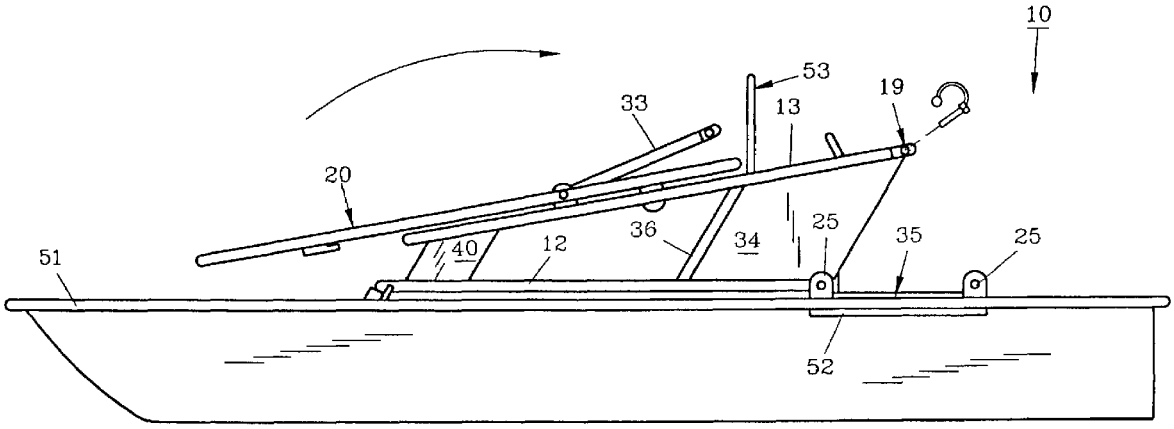
FIG. 3 demonstrates the top as shown in FIG. 2 with the shade frame pivoted rearwardly.
Figure 4:
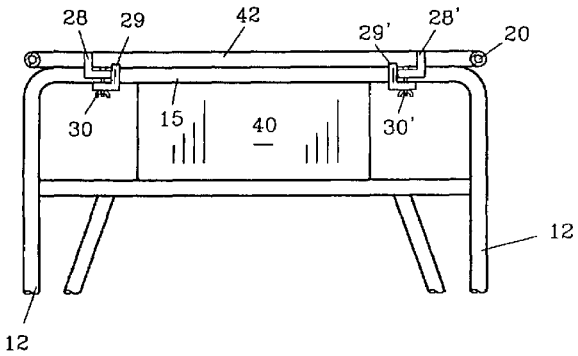
FIG. 4 features a section of the tiltable boat top as seen along lines 4—4 of FIG. 1.

For a better understanding of the invention and its operation, turning now to the drawings, FIG. 1 demonstrates the preferred form of the invention as shown by tiltable boat top 10 attached by arch 11 to skiff 50. Arch 11, as shown in FIGS. 1–3, 10 and 11 is affixed to gunwales 51, 51' along each side of skiff 50. To provide support for gunwales 51, 51' wooden gunwale supports 52, 52', such as a conventional 2"×4" (two by four) are secured to gunwales 51, 51' as by bolts or other standard fasteners (not seen). Arch 11 is also attached to shade frame 20 which is pivoted along with arch 11 as shown in FIGS. 2 and 3.

Figure 9:
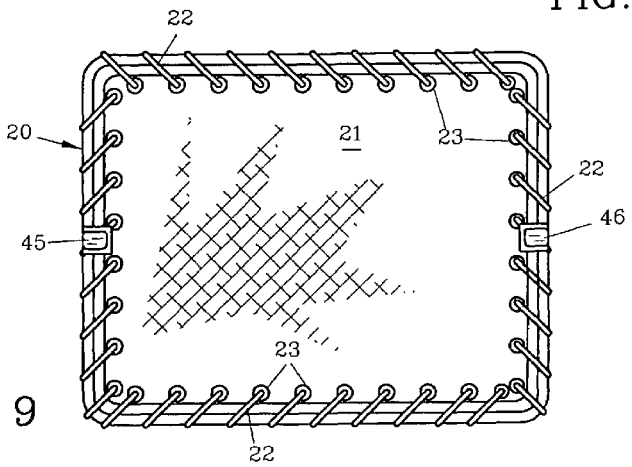
FIG. 9 depicts a top plan view of the shade frame and shade frame cover.

Shade frame 20 is rectangular in shape as shown in FIG. 9 and is preferably formed of schedule 40 aluminum tubing with a diameter of 1½ inches (3.81 cm). Shade frame cover 21 is lashed to shade frame 20 with standard nylon rope 22 which passes through grommets 23 and around shade frame 20. Shade frame cover 21 is preferably formed of Sunbrella™ fabric as manufactured by Glen Raven Mills of Glen Raven, N.C. Vinyl or canvas covers could likewise be used but are not preferred. Conventional red and green navigational lights 45 are shown in FIGS. 1 and 9 along with conventional white stern light 46. Other views do not include lights 45, 46 attached to shade frame 20 for clarity purposes.

Figure 11:
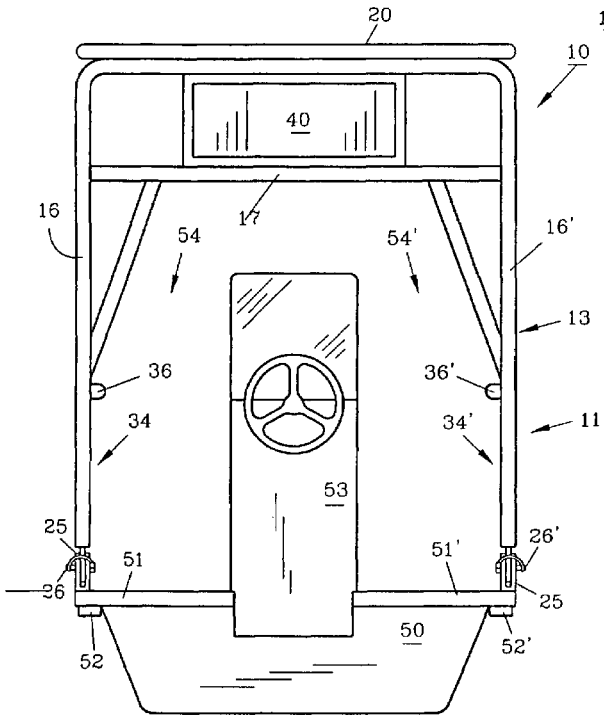
FIG. 11 demonstrates a rear elevational view of the tiltable boat top as shown in FIG. 10.
Figure 10:
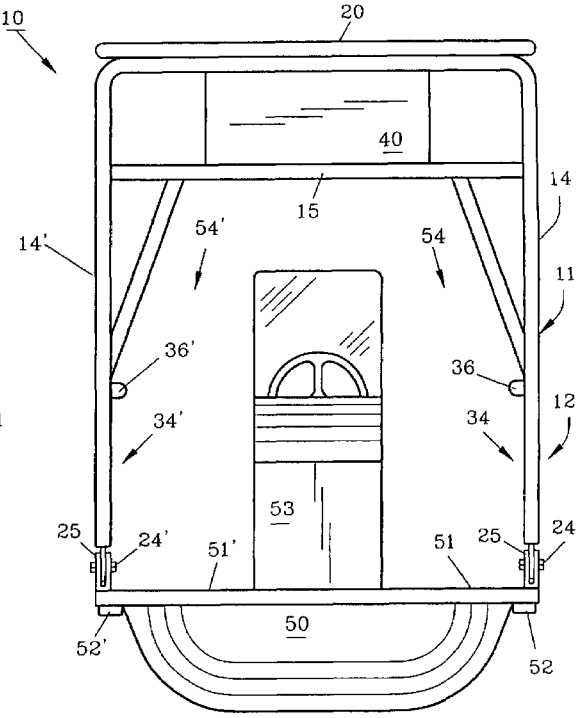
FIG. 10 illustrates a front elevational view of the tiltable boat top in an upright posture on the skiff.

Steering console 53 within skiff 50 in FIGS. 10 and 11 shows boat top 10 positioned thereover to maximize the shade and protection for the boat operator (not seen) at steering console 53. In addition, aisles 54, 54' on each side of steering console 53 are essentially free and clear of obstacles, as arch 11 is mounted on gunwales 51, 51', when boat top 10 is in its upright position. Metal storage chest 40 is attached to arch 11 and can be used to store charts, tools and other supplies in a safe, dry condition.

As further shown in FIGS. 1, 2, 3, 10 and 11, planar splash panels 34, 34' include top arm rests 36, 36' respectively which can be used for support by a passenger or the like while standing in aisles 54, 54' respectively. Splash panels 34, 34' are preferably formed from quarter inch (0.635 cm) aluminum plate and are attached as by welding to front tubular frame member 12 and rear tubular frame member 13 as shown in FIG. 1. Tubular frame members 12 and 13 are preferably of 1½ inch (3.81 cm) diameter schedule 40 aluminum tubing. Splash panel 34 offers a degree of water protection to the boat operator while underway to help prevent water spray from entering skiff 50. Resilient gasket 35 is attached to gunwale 51 as shown in FIGS. 1, 10 and 11. Gaskets 35, 35' (not seen) are conventional sealing gasket materials as purchased at conventional retail outlets and prevent water passing between splash panels 34, 34' and gunwales 51, 51', respectively.

Front tubular frame member 12 of arch 11 consists of legs 14, 14' joined to transverse member 15 as shown in FIG. 10, whereas rear tubular frame member 13, as shown in FIG. 11, consists of legs 16, 16' connected to transverse member 17. Legs 14, 14' can be integrally formed with transverse members 15, 15' by molding or bending, or can be welded thereto as desired. Likewise, rear tubular frame member 13 is also formed.

Tiltable boat top 10 can be easily attached to skiff 50 shown in FIG. 1 by affixing conventional U-shaped pivot bases 25 to gunwales 51, 51' as shown in FIGS. 1, 10 and 11 by bolts, screws or other standard fasteners. Conventional U-shaped pivot base 25 is preferably formed from stainless steel. Not seen in FIGS. 1 and 2, front tubular frame member 12 includes apertures 18, 18' on the lower flattened ends of legs 14, 14' held respectively in pivot bases 25 with bolts 24, 24' (shown for example in FIG. 10). Pivot base 25 allows arch 11 to rotate upon release of rear tubular frame member 13. Rear tubular frame member 13, as shown in FIGS. 2 and 11, includes apertures 19, (19' not seen) in the flattened ends of legs 16, 16' through which conventional locking pins 26, 26' are inserted. Conventional locking pin 26 as seen in FIGS. 10 and 11 includes a loop for securement purposes and upon release of locking pins 26, 26' arch 11 can rotate about bolts 24.

Figure 5:
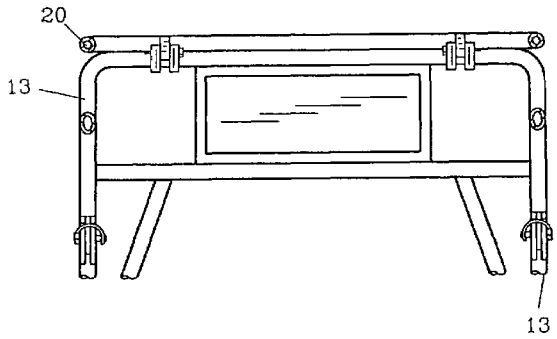
FIG. 5 depicts another sectional view of the tiltable boat top as seen along lines 5—5 of FIG. 1.
Figure 7:
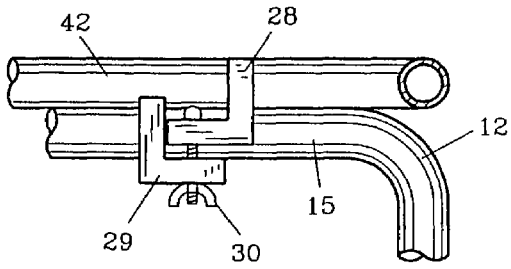
FIG. 7 shows a view of the shade frame along lines 7—7 of FIG. 6.
Figure 8:
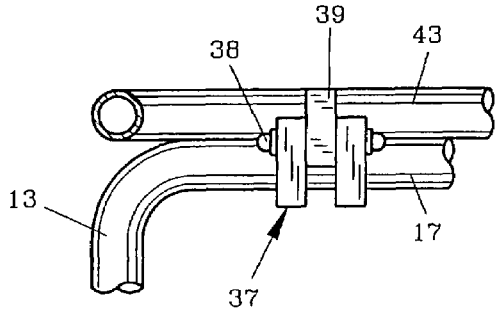
FIG. 8 illustrates another view of the shade frame as along lines 8—8 of FIG. 6.

The method of tilting boat top 10 includes first, the removal of locking pins 26, 26' as shown in FIG. 11. Next, wing nuts 30, (30' not seen in all views) are removed as shown in FIGS. 5, 7 and 8. By removing wing nuts 30, 30' angle bracket 28 affixed to front shade frame brace 42 is released from angle bracket 29 attached to transverse member 15 as shown in FIGS. 7 and 8. Likewise on the other side, angle bracket 28' is similarly released from angle bracket 29' as shown in FIG. 5. Next, shade frame brace pins 32, 32' are removed to release shade frame braces 33, 33' from rear tubular frame member 13 to allow shade frame 20 to pivot. (see FIG. 1).

Figure 6:
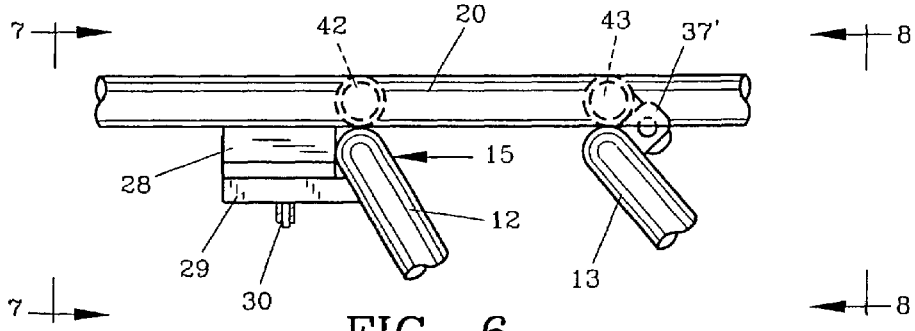
FIG. 6 features a sectional side elevational view of a portion of the shade frame.

Thereafter, arch 11 is manually tilted forwardly as shown in FIG. 2 whereby front tubular frame member 12 substantially rests on gunwale 51. (As would be understood the same occurs on the opposite boat side as tubular frame member 12 also rests on gunwale 51'). Next, shade frame 20 is rotated in a clockwise direction as shown in FIG. 3 so shade frame 20 substantially rests against and is parallel to rear tubular frame member 13 at an acute horizontal angle. Shade frame 20 includes a pair of clevis attachments 37, 37' therealong as shown in FIGS. 6–8. Clevis attachments 37, 37' include clevis bolts 38, 38' (38" not shown) to allow rotation of shade frame 20 on rear tubular frame member 13 (transverse member 17) as shown in FIG. 6. As seen, clevis connectors 39, 39' (39' not shown) are attached to rear shade frame brace 43 which are engaged by clevis attachments 37, 37' affixed to rear tubular frame member 13 as shown in FIGS. 6 and 8.

Thus, the boat operator (not shown) can quickly lower boat top 10 from an upright position with shade frame 20 substantially horizontal to a fully lowered position as shown in FIG. 3 with shade frame 20 at an acute angle to the horizon in a matter of minutes. By reversing the steps above boat top 10 with shade frame 20 can be quickly erected and returned to its fully upright position to provide shade and weather protection.

The illustrations and examples provided herein are for explanatory purposes and are not intended to limit the scope of the appended claims.

What is claimed is:

1. A tiltable boat top for attachment to boat gunwales comprising: an arch, said arch comprising a front and a rear frame member, said front frame member rigidly joined to said rear frame member, said arch positioned across said boat, said arch pivotally and releasably attached to each gunwale on opposite sides of the boat, a shade frame, said shade frame pivotally attached to said rear frame member, and releasably attached to said front frame member, whereby said arch can be selectively raised by rotating said arch rearwardly and rotating said shade frame forwardly into a horizontal posture above the boat when sun protection is needed and thereafter said arch can be lowered by selective rotation in a forward direction and said shade frame pivoted in a rearward direction so the lowered shade frame is forward of the pivotal attachment of said arch to the gunwales.

2. The tiltable boat top of claim 1 further comprising a splash panel, said splash panel positioned on said arch contiguous the gunwale of said boat.

3. The tiltable boat top of claim 2 wherein said splash panel comprises an aluminum plate.

4. The tiltable boat top of claim 2 further comprising an arm rest, said arm rest affixed atop said splash panel.

5. The tiltable boat top of claim 2 further comprising a gasket, said gasket attached to said gunwale, said splash panel positioned on said gasket.

6. The tiltable boat top of claim 1 wherein each of said frame members comprises a pair of legs, a transverse member, said legs attached at opposite ends of said transverse member.

7. The tiltable boat top of claim 1 wherein said arch is formed from tubular material.

8. The tiltable boat top of claim 1 further comprising a cover, said cover attached to said shade frame.

9. The tiltable boat top of claim 8 wherein said cover is flexible.

10. The tiltable boat top of claim 1 further comprising a storage chest, said storage chest attached to said arch below said shade frame.

11. A method for selectively lowering a tiltable boat top attached to boat gunwales for shade and protection when the top is in a raised posture, said top comprising an arch, said arch extending across the boat and pivotally and releasably attached to the gunwales with removable pins, a shade frame, said shade frame pivotally and releasably attached to the top of the arch, the method comprising the steps of:

a) unlocking the arch from the gunwales;

b) rotating the arch forwardly on the gunwales;

c) unlocking the shade frame from the arch; and d) rotating the shade frame rearwardly on the arch.

12. The method of claim 11 wherein the step of unlocking the arch comprises the step of removing a locking pin which attaches the arch to the gunwales.

13. The method of claim 12 wherein the step of unlocking the shade frame comprises the step of releasing an angle bracket attached to the arch.

14. The method of claim 11 wherein the step of rotating the shade frame rearwardly comprises the step of rotating the shade frame to a position substantially parallel with the arch.

* * * * *